US010000909B2

(12) United States Patent
Mueller

(10) Patent No.: US 10,000,909 B2
(45) Date of Patent: Jun. 19, 2018

(54) CONTROL DEVICE FOR HYDRAULIC EQUIPMENT

(71) Applicant: Altec Industries, Inc., Birmingham, AL (US)

(72) Inventor: Joshua Daniel Mueller, Saint Joseph, MO (US)

(73) Assignee: Altec Industries, Inc., Birmingham, AL (US)

( * ) Notice: Subject to any disclaimer, the term of this patent is extended or adjusted under 35 U.S.C. 154(b) by 235 days.

(21) Appl. No.: 14/976,110

(22) Filed: Dec. 21, 2015

(65) Prior Publication Data

US 2017/0175361 A1 Jun. 22, 2017

(51) Int. Cl.

| | |
|---|---|
| ***E02F 3/84*** | (2006.01) |
| ***E02F 9/20*** | (2006.01) |
| ***E02F 9/22*** | (2006.01) |
| ***G05G 9/047*** | (2006.01) |

(52) U.S. Cl.

CPC ..... *E02F 9/22* (2013.01); *G05G 9/047* (2013.01); *E02F 3/84* (2013.01); *E02F 3/844* (2013.01); *E02F 9/20* (2013.01); *E02F 9/2004* (2013.01)

(58) Field of Classification Search

None

See application file for complete search history.

(56) References Cited

U.S. PATENT DOCUMENTS

| | | | | |
|---|---|---|---|---|
| 3,296,882 | A | 1/1967 | Durand | |
| 5,532,476 | A | 7/1996 | Mikan | |
| 7,129,428 | B2 | 10/2006 | Edmunds | |
| 7,497,298 | B2 * | 3/2009 | Shearer | E02F 3/7663 180/333 |
| 9,551,130 | B2 * | 1/2017 | Hendron | E02F 3/844 |
| 2008/0201994 | A1 * | 8/2008 | Crago | E01H 5/06 37/197 |
| 2008/0300055 | A1 | 12/2008 | Lutnick et al. | |
| 2014/0026550 | A1 | 1/2014 | Brinkman et al. | |
| 2014/0100743 | A1 * | 4/2014 | Foster | A01D 41/1274 701/50 |
| 2016/0179128 | A1 * | 6/2016 | Guglielmo | B66F 11/04 182/19 |
| 2017/0114522 | A1 * | 4/2017 | Maifield | E02F 3/764 |

* cited by examiner

*Primary Examiner* — Thomas G Black
*Assistant Examiner* — Demetra R Smith-Stewart
(74) *Attorney, Agent, or Firm* — Erise IP, P.A.

(57) ABSTRACT

Systems and methods for intelligently gated operation of hydraulic equipment. Control logic for operating a number of hydraulic functions of hydraulic equipment using the same physical controls is disclosed, including dynamic gating functions that allow the same controller to operate gated and ungated functions. By adjusting control inputs for each axis, the controls can be operated jointly, mutually exclusively or in a blended fashion. Additionally, control signals for one axis can be adjusted based on the control signal for the other axis to prevent abrupt transitions from controlling one function to controlling another function.

20 Claims, 6 Drawing Sheets

CONTROL DEVICE FOR HYDRAULIC EQUIPMENT

BACKGROUND

1. Field

Embodiments of the invention generally relate to control devices for hydraulic equipment and, more particularly, to systems and methods for intelligently gating control functions of hydraulic equipment so that the same physical controller can be used to control different hydraulic equipment without physical gates.

2. Related Art

Traditionally, hydraulic equipment has been operated by dedicated controls, with one control axis for each hydraulic function. For example, when a boom can be raised or lowered and also rotated, there is one control for raising and lowering, and one control for rotating. For efficiency or joint operation, controls are sometimes combined into two-axis joysticks, so that moving the joystick on the y-axis raises or lowers the boom, and moving the joystick on the x-axis rotates the boom.

For some hydraulic equipment, it is desirable to operate the two control functions at the same time (for example, to simultaneously rotate and raise the boom). In other examples, however, the control functions should not operate simultaneously. For example, there is not a reason to operate the winch and the digger at the same time so simultaneous activation is likely unintentional. To enforce these exclusions, physical gates can be used to restrict the movement of the joystick so that it can move in either the x-axis direction or the y-axis direction, but not both simultaneously.

However, controls that are mechanically gated in this fashion cannot be reused to control functions that require joint operation. For example, if a hydraulic equipment vehicle has a number of functions, then separate joysticks are required for each function, gated or not as the particular function requires. This prevents joysticks from being reconfigured to control different hydraulic equipment as needed. As such, there is a need for a way to dynamically and intelligently gate control inputs so that controls can be reused for different functions while being gated appropriately for current functions.

SUMMARY

Embodiments of the invention address the above-described need by providing an intelligently gated multifunction controller for hydraulic equipment. In particular, in a first embodiment, the invention includes a mobile hydraulic equipment vehicle, comprising a joystick, freely movable in an first direction and a second direction, a vehicle incorporating a hydraulic device with a first hydraulic function and a second hydraulic function, a processor, one or more computer-readable media storing computer-executable instructions which, when executed by the processor, perform a method of electronic gating, comprising the steps of determining an first magnitude corresponding to a position of the joystick in the first direction, determining a second magnitude corresponding to a position of the joystick in the second direction, if the first magnitude is larger than the second magnitude determining an adjusted first magnitude by reducing the first magnitude based on the second magnitude, and sending the first hydraulic function a first control signal based on the adjusted first magnitude.

In a second embodiment the invention includes a system for controlling an item of hydraulic equipment, comprising a multifunction controller incorporating a plurality of joysticks, each joystick freely movable in an x direction and a y direction, a hydraulic controller configured to control a first function of the item of hydraulic equipment and a second function of the item of hydraulic equipment, a gating controller configured to receive a signal from a first joystick of the plurality of joysticks indicating an x magnitude corresponding to a distance the first joystick has been moved in the x direction and a y magnitude corresponding to a distance the joystick has been moved in the y direction, compare the x magnitude to the y magnitude, upon determining that the x magnitude is larger than the y magnitude, adjust the x magnitude based on the y magnitude and adjust the y magnitude to zero, and transmit the adjusted x magnitude and the adjusted y magnitude to the hydraulic controller.

In a third embodiment the invention includes a method of controlling an item of hydraulic equipment having a first function and a second function, comprising the steps of receiving, from a joystick freely movable in an x direction and a y direction, an x magnitude indicating how far the joystick has been moved in the x direction and a y magnitude indicating how far the joystick has been moved in the y direction, comparing the x magnitude and the y magnitude, if the x magnitude is greater than the y magnitude, adjusting the x magnitude based on the y magnitude, and operating the first function of the item of hydraulic equipment in accordance with the adjusted x magnitude.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
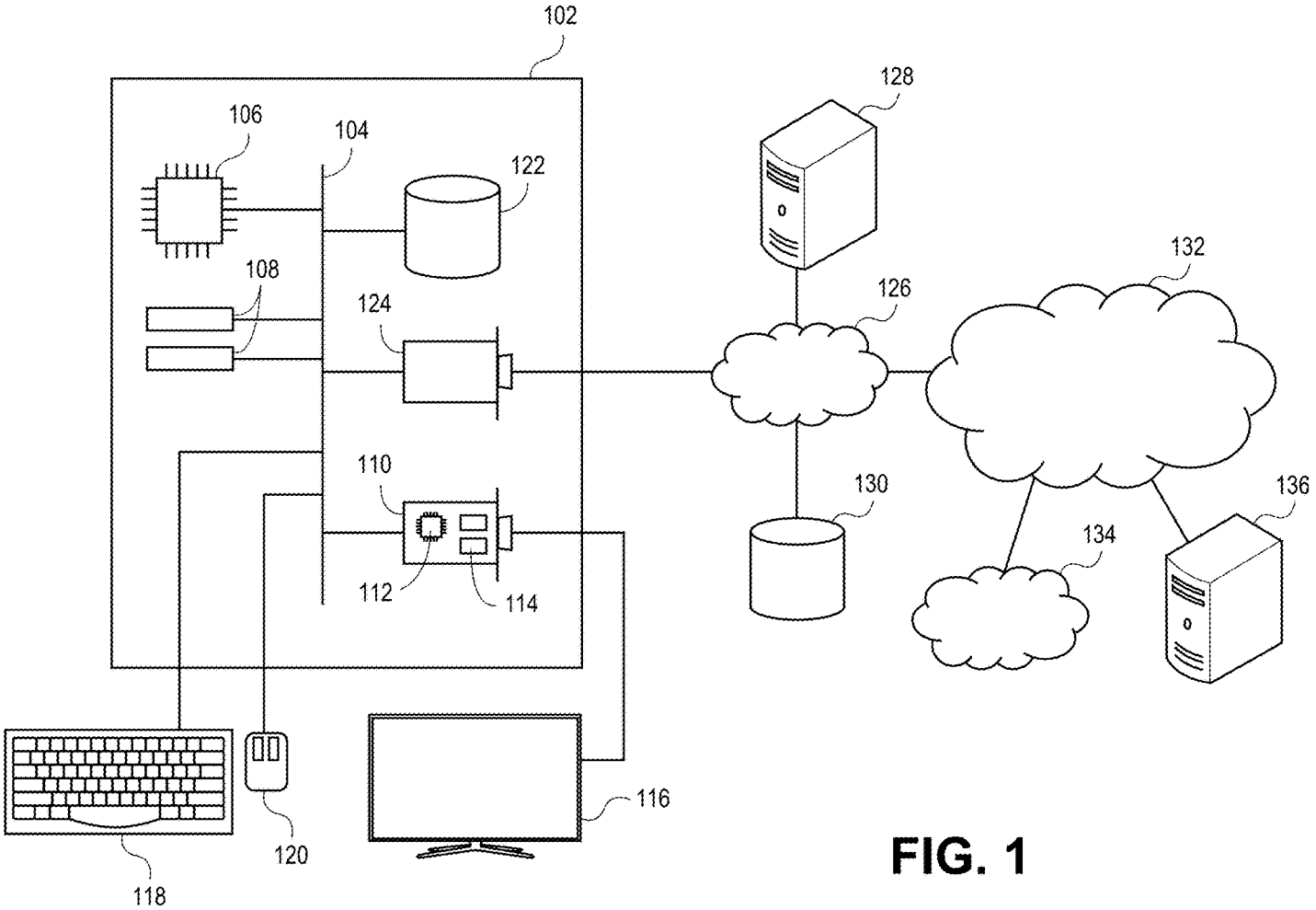
FIG. 1 depicts an exemplary hardware platform for certain embodiments of the invention.

The drawing figures do not limit the invention to the specific embodiments disclosed and described herein. The drawings are not necessarily to scale, emphasis instead being placed upon clearly illustrating the principles of the invention.

DETAILED DESCRIPTION

At a high level, embodiments of the invention allow for improved controllers for mobile hydraulic equipment. Typically, mobile hydraulic equipment vehicles include multiple pieces of hydraulic equipment, each of which may include multiple functions. For example, a digger derrick may include a hydraulic auger (with separate controls to position and engage the auger) and a winch or claw for lifting and positioning poles in the holes dug by the auger (with separate controls for engaging the claw and for positioning the pole). These controls typically take the form of two-axis joysticks. Thus, for example, moving a joystick along the x-axis might control the rotation of a boom, while moving along the y-axis might control the tilt of the boom. Furthermore, to reduce the number of controls required for a vehicle control station, users can switch the controls from operating a first piece of hydraulic equipment to operate a second piece of hydraulic equipment. Thus, a pair of joysticks used to operate the auger can be reconfigured to operate the claw or winch.

For some hydraulic equipment the control functions on each axis should be jointly operable and for other equipment, they should be mutually exclusive. For example, when controlling a claw to position a pole in a hole, the arm may need to be rotated to maintain the position of the base of the pole as the claw rotates to tilt the pole into a vertical orientation. Thus, when arm position and claw rotation are mapped to the same control, the user needs to position the joystick in a diagonal position so that both the x-axis function and the y-axis function are engaged. However, if the functions for claw rotation and claw opening/closing are instead mapped to the same control, only one of these functions should be operable at a time, lest the user unintentionally open the claw while attempting to rotate the pole into position.

When dedicated controls are used for each item of hydraulic equipment, this is not a problem, because physical gates can be installed in the joystick to prevent off-axis operation. However, because remappable joysticks may be required to operate in a joint operation mode when configured to control a first piece of hydraulic equipment and in a mutually exclusive mode when operating a second piece of hydraulic equipment, physical gates are infeasible. As such, embodiments of the invention provide for software gates that can allow a joystick to operate safely in either a joint operation mode or a mutually exclusive mode by remapping a physical joystick position on its x-axis and y-axis into a virtual position in a manner dependent on the needs of the equipment being controlled.

The subject matter of embodiments of the invention is described in detail below to meet statutory requirements; however, the description itself is not intended to limit the scope of claims. Rather, the claimed subject matter might be embodied in other ways to include different steps or combinations of steps similar to the ones described in this document, in conjunction with other present or future technologies. Minor variations from the description below will be obvious to one skilled in the art, and are intended to be captured within the scope of the claimed invention. Terms should not be interpreted as implying any particular ordering of various steps described unless the order of individual steps is explicitly described.

The following detailed description of embodiments of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of embodiments of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate reference to "one embodiment" "an embodiment", or "embodiments" in this description do not necessarily refer to the same embodiment and are also not mutually exclusive unless so stated and/or except as will be readily apparent to those skilled in the art from the description. For example, a feature, structure, or act described in one embodiment may also be included in other embodiments, but is not necessarily included. Thus, the technology can include a variety of combinations and/or integrations of the embodiments described herein.

Turning first to FIG. 1, an exemplary hardware platform for certain embodiments of the invention is depicted. Computer 102 can be a desktop computer, a laptop computer, a server computer, a mobile device such as a smartphone or tablet, or any other form factor of general- or special-purpose computing device, usable for remotely controlling the equipment as discussed below. In other embodiments, computer 102 takes the form of an embedded controller and may omit the traditional peripherals depicted and described below in favor of dedicated input controls and outputs for operating the equipment. Depicted with computer 102 are several components, for illustrative purposes. In some embodiments, certain components may be arranged differently or absent. Additional components may also be present. Included in computer 102 is system bus 104, whereby other components of computer 102 can communicate with each other. In certain embodiments, there may be multiple busses or components may communicate with each other directly. Connected to system bus 104 is central processing unit (CPU) 106. Also attached to system bus 104 are one or more random-access memory (RAM) modules. Also attached to system bus 104 is graphics card 110. In some embodiments, graphics card 104 may not be a physically separate card, but rather may be integrated into the motherboard or the CPU 106. In some embodiments, graphics card 110 has a separate graphics-processing unit (GPU) 112, which can be used for graphics processing or for general purpose computing (GPGPU). Also on graphics card 110 is GPU memory 114. Connected (directly or indirectly) to graphics card 110 is display 116 for user interaction. In some embodiments no display is present, while in others it is integrated into computer 102. Similarly, peripherals such as keyboard 118 and mouse 120 are connected to system bus 104. Like display 116, these peripherals may be integrated into computer 102 or absent. Also connected to system bus 104 is local storage 122, which may be any form of computer-readable media, and may be internally installed in computer 102 or externally and removeably attached.

Computer-readable media include both volatile and nonvolatile media, removable and nonremovable media, and contemplate media readable by a database. For example, computer-readable media include (but are not limited to) RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data temporarily or permanently. However, unless explicitly specified otherwise, the term "computer-readable media" should not be construed to include physical, but transitory, forms of signal transmission such as radio broadcasts, electrical signals through a wire, or light pulses through a fiber-optic cable. Examples of stored information include computer-usable instructions, data structures, program modules, and other data representations.

Finally, network interface card (NIC) 124 is also attached to system bus 104 and allows computer 102 to communicate over a network such as network 126. NIC 124 can be any form of network interface known in the art, such as Ethernet, ATM, fiber, Bluetooth, or Wi-Fi (i.e., the IEEE 802.11 family of standards). In vehicular embodiments, a controller area network (CAN) and/or the RS-485 (also known as TIA-485 or TIA-485-A) standard can be used for communication between components. NIC 124 connects computer 102 to local network 126, which may also include one or more other computers, such as computer 128, and network storage, such as data store 130. Generally, a data store such as data store 130 may be any repository from which information can be stored and retrieved as needed. Examples of data stores include relational or object oriented databases, spreadsheets, file systems, flat files, directory services such as LDAP and Active Directory, or email storage systems. A data store may be accessible via a complex API (such as, for example, Structured Query Language), a simple API providing only read, write and seek operations, or any level of complexity in between. Some data stores may additionally provide management functions for data sets stored therein such as backup or versioning. Data stores can be local to a single computer such as computer 128, accessible on a local network such as local network 126, or remotely accessible over Internet 132. Local network 126 is in turn connected to Internet 132, which connects many networks such as local network 126, remote network 134 or directly attached computers such as computer 136. In some embodiments, computer 102 can itself be directly connected to Internet 132.

In some embodiments, computer 102 is directly connected to and controls equipment as discussed below. In other embodiments, computer 102 communicates via network 126 or Internet 132 with another computer (such as computer 128 or computer 136) that controls the equipment. In still other embodiments, computer 102 controls (directly or indirectly) simulated equipment (for example, for the purpose of training an equipment operator).

Figure 2:
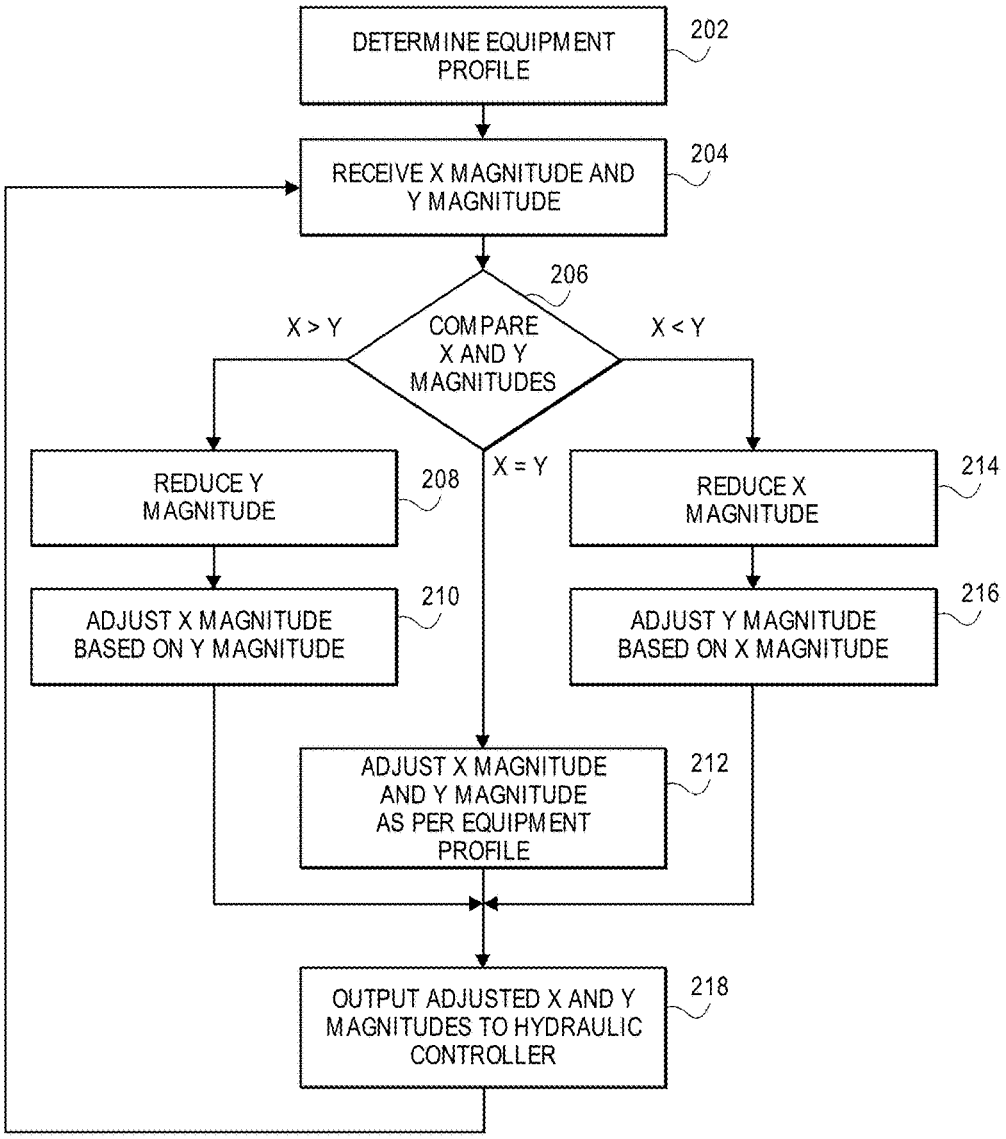
FIG. 2 depicts a flowchart depicting a method of controlling hydraulic equipment.

Turning now to FIG. 2, a flowchart depicting a method of controlling hydraulic equipment is depicted and referred to generally by reference numeral 200. Initially, at a step 202, an equipment profile is determined. Broadly, this equipment profile determines how the (physical) magnitude in the x-axis and y-axis are mapped to the adjusted x- and y-axis magnitudes sent to the hydraulic controls for the equipment. For example, a joint operation equipment profile might specify that the x-axis magnitude and y-axis magnitude are passed through unchanged to the hydraulic equipment controller. In an alternate configuration, the equipment profile might be basic mutual exclusion profile such that the axis with greater magnitude is passed through to the hydraulic controller, while the axis with the smaller magnitude is adjusted to zero magnitude to prevent unintentional operation. Further equipment profiles are discussed below with respect to FIGS. 4(A) to 4(C).

The equipment profile may be selected from among a set of profiles associated with a particular joystick being controlled, or from among all available equipment profiles. In some embodiments, the equipment profile can be selected automatically based on a user selection of a piece of equipment to be controlled. For example, in the digger derrick example given above, selecting the auger might choose a joint operation profile for both the joystick controlling the rotation and extension of the auger arm and the joystick controlling the revolution and vertical position of the auger. If the user subsequently begins to operate the claw instead, a joint operation profile might be automatically selected for the joystick controlling the tilt and rotation of the arm, while a mutual exclusion profile might be selected for the joystick controlling the rotation and opening/closing of the claw. Other equipment might use the same or different sets of equipment profiles, and users may have the option of selecting a non-default profile for a given piece of equipment.

Processing then proceeds to a step 204, where joystick input from a user is received. As discussed in further detail below, the term "joystick" is used for brevity, but any two-axis (or more than two-axis) input device can be used instead. In some embodiments, such as a conventional joystick, absolute offsets for the x-axis and the y-axis are received. In such embodiments, a zero magnitude for both axes would be received only when the controller is centered. In other embodiments, such as a trackball, a relative offset (or delta) between the current position and the previous position is provided instead. In such embodiments, zero magnitudes for both axes are received whenever the controller is fixed in its current position. In some such embodiments, absolute offsets are calculated from the relative offsets, adjusted as described below, and passed to the hydraulic controller. In other such embodiments, the relative offsets themselves are adjusted and passed to the hydraulic controller.

Once the magnitudes for the x- and y-axes have been determined, processing proceeds to a step 206, wherein the relative x-axis and y-axis magnitudes are compared. In other words, this comparison determines whether the joystick is further in a horizontal direction (i.e., displaced along the x-axis) or in a vertical direction (i.e., displaced along the y-axis). If the x magnitude is greater than the y magnitude, processing proceeds to step 208. If the x and y magnitudes are equal, processing proceeds to step 212. If the x magnitude is less than the y magnitude, processing proceeds to step 214.

At step 208, the y magnitude is reduced for those equipment profiles that do not require full joint operation. For some equipment profiles, the y magnitude is reduced to zero if it is less than the x magnitude. Such profiles include mutually exclusive equipment profiles (i.e., those where only one of the control functions should be engaged at a time). In still other embodiments, the y magnitude may be reduced based on the x magnitude. For example, it may be desired to blend the x and y magnitudes such that the adjusted x magnitude is decreased based on the y magnitude and the adjusted y magnitude is decreased based on the x magnitude. As with all of steps 208-216, the nature of the adjustments in the x and y magnitudes is determined by the equipment profile determined at step 202.

Next, as step 210, the x magnitude is adjusted based on the y magnitude according to the equipment profile. As discussed below, this can allow mutually exclusive equipment profiles to prevent abrupt and unintentional switching from activating the function on the x-axis to the function on the y-axis by inadvertently moving the joystick through the 45-degree line. In some embodiments, x is reduced to zero if the y magnitude is greater than a threshold value. Thus, if the joystick is outside of a cross-shaped region around the x- and y-axes, then the joystick will be deactivated as if it were in the zero position. Such an equipment profile recreates the effect of the physical restriction gate described above. See FIG. 4(A) for an example of such an equipment profile. In other embodiments, the x magnitude is reduced proportionally to the y magnitude. In such embodiments, the activation of the function on the x-axis will slowly fade as the joystick deviates from the axes. In this way, smooth transition from no activation of each function to full activation of that function is assured, regardless of the position of the joystick on the opposite axis. See FIG. 4(C) for an example of this type of equipment profile.

If the joystick is positioned on a diagonal (i.e., where the x magnitude is equal to the y magnitude), then processing proceeds to step 212, where the x and y magnitudes are adjusted according to the equipment profile selected at step 202. For example, in joint operation profiles, the x and y magnitudes may be passed through unadjusted. On the other hand, in mutual exclusion equipment profiles, both x and y magnitudes may be reduced to zero if they are equal, to prevent simultaneous activations of both functions. Other possibilities are also possible, depending on the selected equipment profile.

If decision 206 determined that the x magnitude is less than the y magnitude, processing proceeds to step 214 instead. At step 214, the x magnitude is decreased according to the selected equipment profile. In some embodiments, step 214 reduces the x magnitude in the same way that step 208 reduces the y magnitude. In other embodiments, the adjustments for the function controlled by the x-axis and the function controlled by the y-axis are adjusted differently. For example, the function on the x-axis may only operate as long as the y magnitude is less than a predetermined threshold, while the function on the y-axis can operate regardless of the x magnitude.

Processing then proceeds to step 216, where the y magnitude is adjusted based on the x-magnitude. As discussed above, in some embodiments the y magnitude may be adjusted based on the x magnitude in the same way that step 210 adjusted the x magnitude based on the y magnitude. In other embodiments, the y magnitude can be adjusted differently or passed through unadjusted.

Next, regardless of the determination at decision 206, processing continues at step 218, where the adjusted x and y magnitudes are sent to the hydraulic controller. In some embodiments, as discussed below, the hydraulic controller is integrated into computer 102 that executes method 200. In other embodiments, computer 102 transmits the adjusted magnitudes to a separate hydraulic controller directly or via a network. In still other embodiments, method 200 is performed by an intermediary controller added between the joystick or joysticks and the hydraulic controller, such as an aftermarket gating filter. Once the magnitudes have been transmitted on to the hydraulic controller, processing returns to step 204 where further magnitudes are received, adjusted and forwarded on. Processing can proceed in this manner until a new equipment profile is selected or the operator is finished using the equipment.

Figure 3:
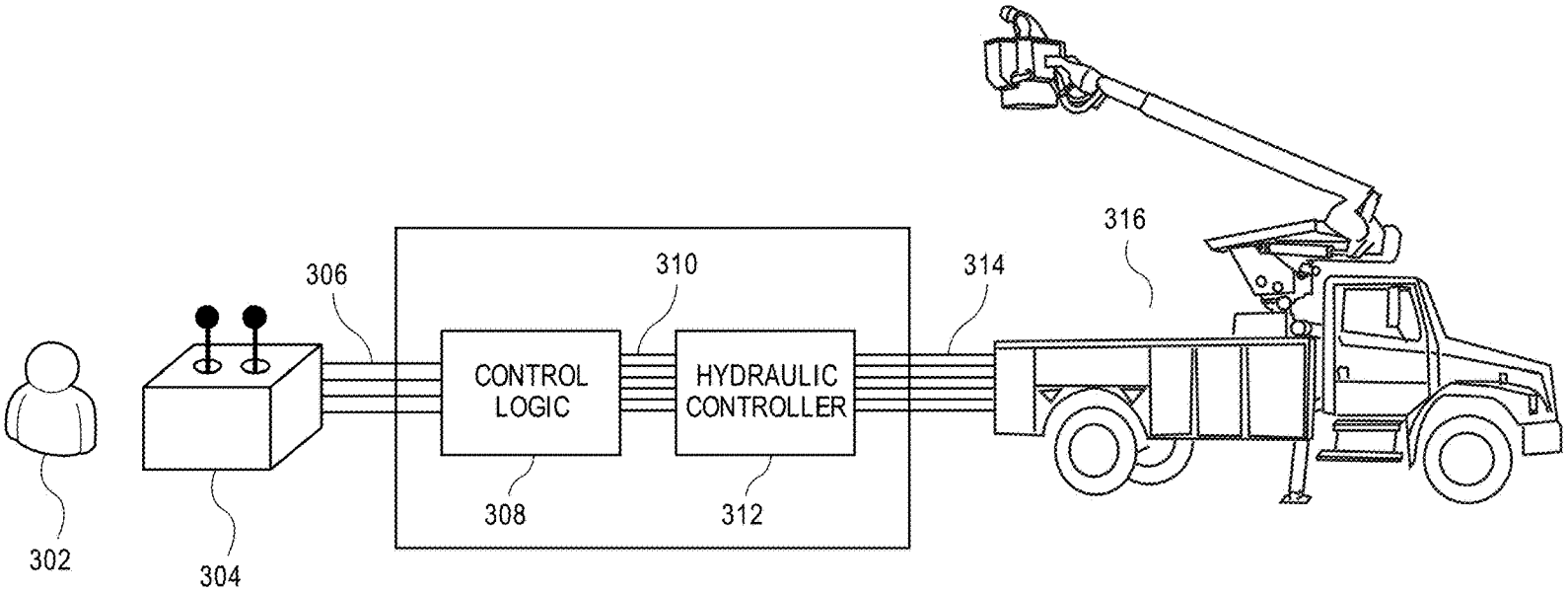
FIG. 3 depicts a block diagram depicting a system suitable for implementing methods in accordance with embodiments of the inventions.

Turning now to FIG. 3, a block diagram depicting a system suitable for implementing method 200 is depicted. User 302 operates multifunction controller 304, which ultimately controls the operation of a hydraulic equipment vehicle 314. As depicted, multifunction controller 304 has two joystick controllers. However, other variations, both in terms of the number of controllers and the type of controller, are also contemplated. For example, a multifunction controller might include only a single joystick, or it might include three or more. Similarly, instead of joysticks, trackballs, mice, touchscreens, gesture recognition, or any other form of control device can be employed. For the sake of brevity, this specification discusses joysticks with two axes; however, one of skill in the art will readily be able to apply the concepts discussed herein to pairs of single-axis controls, or to three-axis (or more) controls. In some embodiments, multifunction controller 304 may further include switches or other input mechanism to reassign the control functions to different pieces of hydraulic equipment. For the sake of brevity, this specification refers to the two axes as the x-axis and the y-axis; however, one of skill in the art will appreciate that additional or alternate axes are also possible. For example, a joystick could be operated by twisting the controller, moving the controller linearly along its shaft, or actuating a thumb wheel. Any of these could replace movement on the x-axis and/or the y-axis.

Control lines 306 convey the signals from each axis of each joystick control of multifunction controller 304 to control logic 308. For example, the depicted two, two-axis joysticks convey four signals to control logic 308: the x-axis and y-axis position of the first joystick and the x-axis and y-axis position of the second joystick. Although four control lines are depicted, it should be appreciated that signals may be multiplexed over a single physical line instead, or over one line per joystick. In some embodiments, one or more joysticks may be dedicated to specific items of hydraulic equipment and routed directly to hydraulic controller 312 without passing through control logic 308.

Control logic 308 maps the controls of multifunction controller 304 to the various functions of hydraulic equipment vehicle 316, and applies appropriate equipment profiles to them when doing so. For example, a joystick might initially control an arm that can move both up/down and in/out with its two axes. Because user 302 might wish to move the arm both up and out simultaneously, a joint operation profile could be applied when the joystick is controlling the arm. If, however, the joystick is subsequently configured to control the rotation and opening/closing of a claw at the end of the arm, a mutually exclusive equipment profile might be used instead so that the claw is not inadvertently opened when user 302 attempts to rotate it. Exemplary equipment profiles are discussed further below with respect to FIGS. 4(A)-4(C).

In addition to adjusting the control signals in accordance with the appropriate equipment profiles, control logic 308 also maps them to the appropriate function control signals on function lines 310. While there is one (conceptual) control line for each control axis of multifunction controller 304, there is one function line for each function of hydraulic equipment vehicle 314. For example, separate function lines may be used to move an arm left, right, up, and down, to open and close a claw, to spin an auger clockwise, and counterclockwise, to raise and lower a lift, or generally to perform any function of hydraulically operated equipment. In some embodiments, each of function lines 310 operates a single hydraulic cylinder so that, for example, separate function lines are used to move an arm left and right. In such embodiments, control logic 308 can separate motion of the joystick in (for example) the positive x-axis and the negative x-axis onto these separate function lines of function lines 310. In other embodiments, a single function line carries a single signal indicating whether the arm should move in a left or right direction, and hydraulic controller 312 separates the signal into appropriate hydraulic lines 314 to operate the arm in the appropriate direction.

Each hydraulic line 314 controls the operation of a single hydraulic function of hydraulic equipment vehicle 316. Hydraulic equipment vehicle 316 is, broadly, any mobile platform with integrated hydraulic equipment. For example, a boom truck (a truck with a mounted crane), an aerial lift (a bucket truck or cherry picker), and a digger derrick (as discussed above) are all examples of mobile hydraulic equipment. Similarly, agricultural equipment such as a combine integrating hydraulic equipment may also be included in the scope of the term. More generally, power-line equipment, tree-care equipment, and telecommunications equipment may be instances where mobile hydraulic equipment is used. However, ordinary vehicles such as cars are not included in the scope of the term.

Figure 4A:
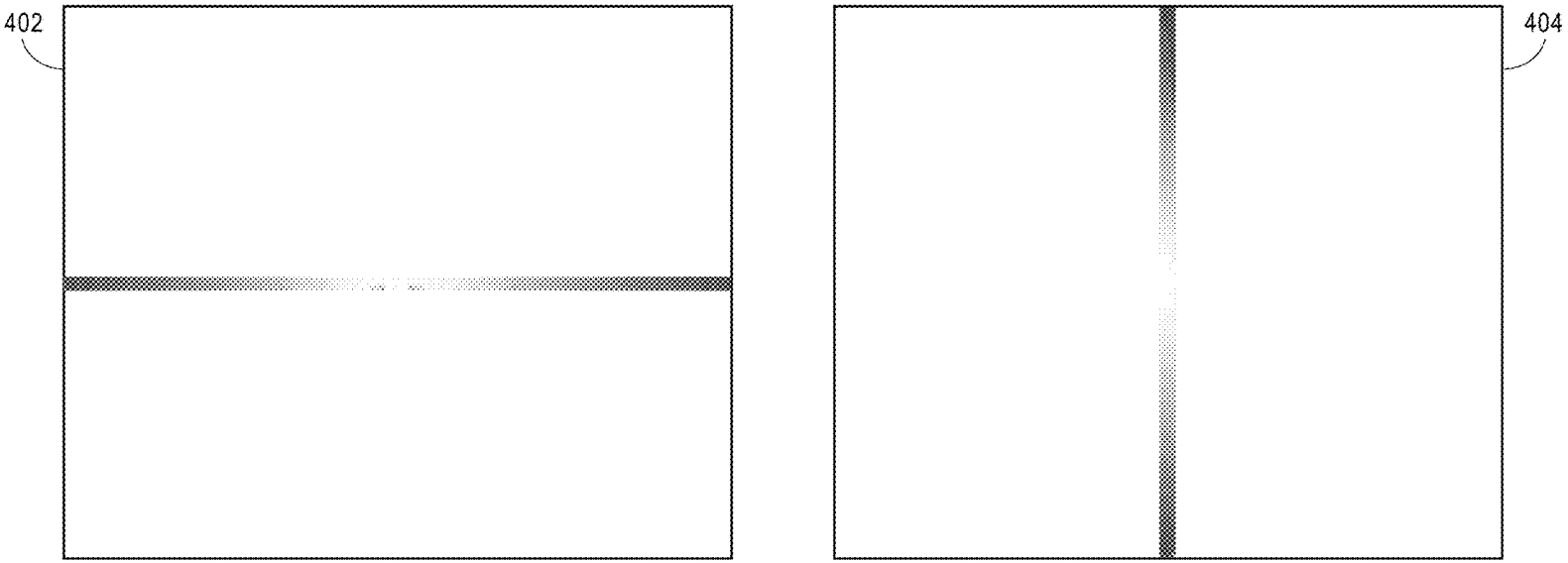
FIG. 4(A) depicts a first exemplary equipment profile suitable for use with embodiments of the invention.

Turning now to FIG. 4(A), an exemplary equipment profile is depicted over the range of x-axis and y-axis inputs. FIG. 4(A) depicts an equipment profile replicating a mechanically gated joystick. For such an equipment profile, it is desired that the joystick outputs be deactivated unless the joystick is within a margin of either the x-axis or the y-axis (i.e., either substantially horizontal or substantially vertical). Graph 402 depicts the output of the function mapped to the x-axis for each position of the joystick, with the darkness of shading corresponding to the magnitude of the output signal. Thus, in graph 402, a greater x magnitude is sent the further the joystick is moved along the x-axis, provided that it is not displaced too far along the y-axis. Of course, the direction of the signal will correspond to the direction of the joystick along the x-axis. Thus, for this equipment profile, step 208 adjusts they magnitude to zero, and step 210 adjusts the x magnitude to zero as well if the y magnitude (prior to adjustment) exceeds a predetermined threshold. Graph 404 depicts the output of the function mapped to the y-axis similarly to the manner in which graph 402 depicts the output of the function mapped to the x-axis. In this case, since a signal is only output to the y-axis function if the joystick is further in the y-axis direction than the x-axis direction, step 214 reduces the x magnitude to zero and the y magnitude to zero as well if the unadjusted x magnitude exceeds the predetermined threshold. In the depicted embodiment, the thresholds for the x- and y-axes are the same; however, in some embodiments, they may differ. Algorithm 1 depicts pseudocode implementing the equipment profile of FIG. 4(A).

Algorithm 1

```
read(x);
read(y);
if(x > y)
{
    if(y > threshold)
    {
        x = 0;
    }
    y = 0;
}
else if (x < y)
{
    if(x > threshold)
    {
        y = 0;
    }
    x = 0;
}
else
{
    x = 0;
    y = 0;
}
output(x);
output(y);
```

Figure 4B:
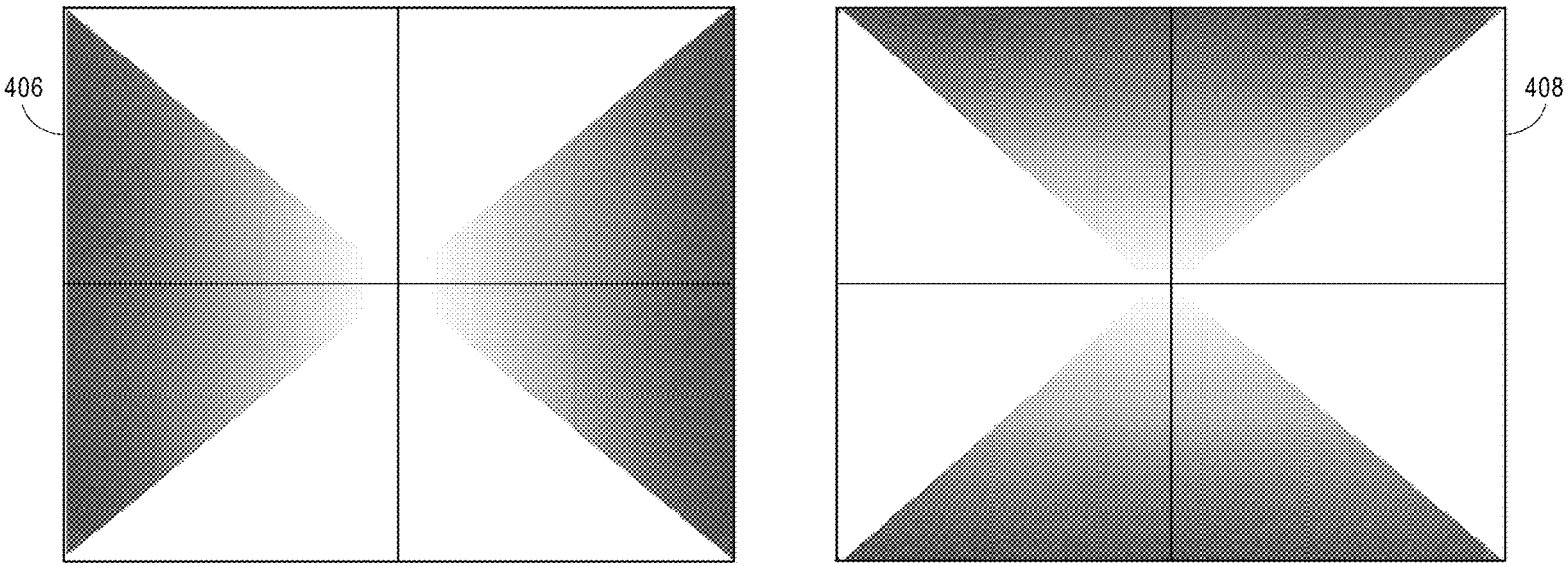
FIG. 4(B) depicts a second exemplary equipment profile suitable for use with embodiments of the invention.

FIG. 4(B) depicts a second exemplary equipment profile over the range of x-axis and y-axis inputs. The equipment profile depicted in FIG. 4(B) represents a basic mutual exclusion profile; i.e., one where either the function on the x-axis can be active or the function on the y-axis can be active, but not both. This equipment profile is suitable for pieces of equipment where the mapped functions should be mutually exclusive, but where there is no concern about abruptly switching from controlling one function to controlling the other function when the joystick passes the x=y line. Graph 406 depicts the signal sent to the function mapped to the x-axis for this equipment profile over the range of x-axis and y-axis inputs, and graph 408 similarly depicts the signal sent to the function mapped to the y-axis. As can be seen, if the joystick crosses Algorithm 2

```
read(x);
read(y);
if(x > y)
{
    y = 0;
}
else if (x < y)
{
    x = 0;
}
else
{
    x = 0;
    y = 0;
}
output(x);
output(y);
```

the x=y line, the signal sent to the x-axis function will abruptly change from a strong signal to zero, and the signal sent to the y-axis function will abruptly change from zero to a strong signal (or, of course, vice versa). In other words, steps 208 and 214 reduce the y magnitude and x magnitude (respectively) to zero, and steps 210 and 216 leave the other magnitude unchanged. Algorithm 2 depicts pseudocode implementing the equipment profile of FIG. 4(B).

Figure 4C:
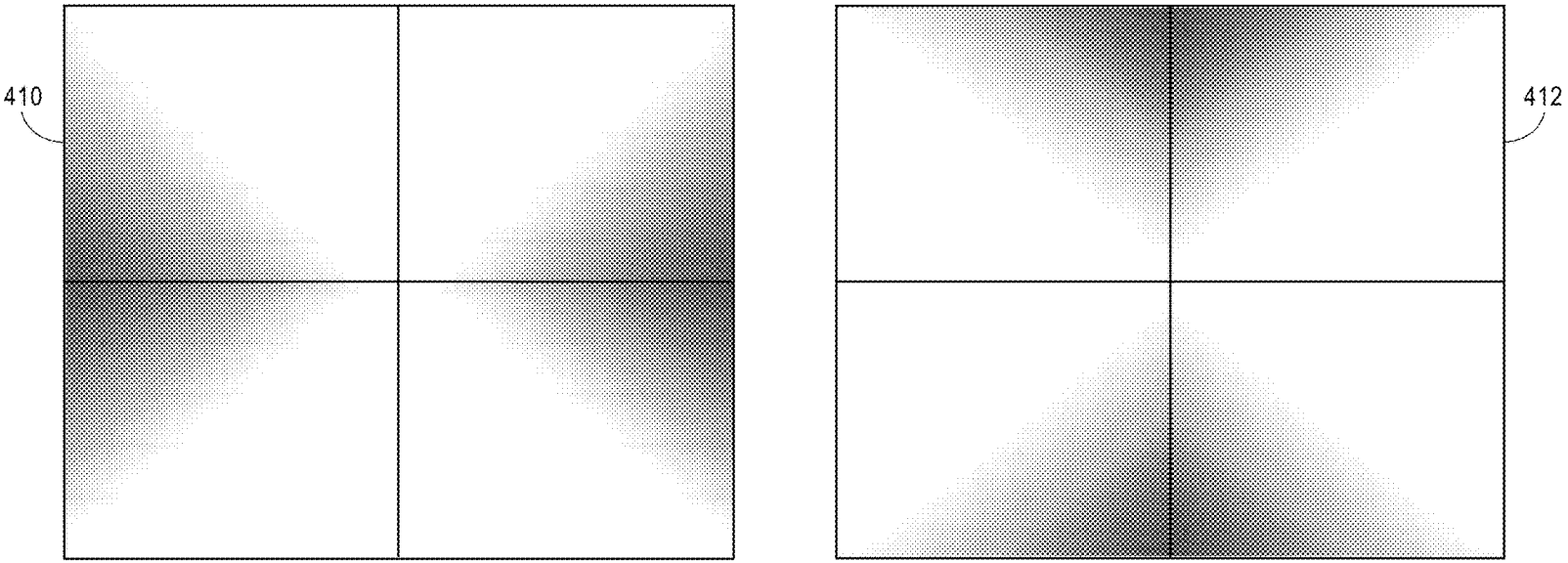
FIG. 4(C) depicts a third exemplary equipment profile suitable for use with embodiments of the invention.

FIG. 4(C) depicts yet another exemplary equipment profile over the range of x-axis and y-axis inputs. The equipment profile depicted in FIG. 4(C) represents an intelligent mutual exclusion profile. For this profile, the abrupt shifts from controlling one function to controlling the other function are avoided. Graph 410 depicts the signal sent to the function assigned to the x-axis for each joystick position, and graph 412 depicts the signal sent to the function assigned to the y-axis for each joystick position. Similarly to the equipment profiles of FIGS. 4(A) and 4(B), the joystick outputs are deactivated when the joystick is precisely along the diagonal axes. Unlike those profiles, however, small joystick movements cannot result in abrupt transitions from a function being activated to the function being completely being deactivated or vice versa. In this way, an operator of the equipment can notice that a decreased signal is being sent, and recenter the joystick on the relevant axis. Conversely, if the operator wishes to switch functions, they can move the joystick directly to the new position without the need to return to center to avoid unnecessary transitions.

In order to accomplish this, step 208 again reduces the y magnitude to zero, and step 210 reduce the x magnitude by a weighting factor times the unadjusted y magnitude. For example, if this weighting factor is one, then the signal sent to the active function will become zero as the joystick reaches the diagonal. If a larger "dead zone" is desired, a larger weighting factor can be used (with the signal limited to a minimum of zero). Alternatively a smaller weighting factor can also be used. In some embodiments, steps 208 and 214 do not reduce y and x (respectively) to zero, but reduce them proportionally to their counterpart. In this way, joystick inputs can be blended (as in a joint operation profile), but reduced in such a way that increasing the signal for one function reduces the signal for the other function and vice versa. Algorithm 3 depicts pseudocode implementing the equipment profile of FIG. 4(C).

Algorithm 3

```
read(x);
read(y);
if(x > y)
{
    x = max(x − (weight * y), 0);
    y = 0;
}
else if (x < y)
{
    y = max(y − (weight * x), 0);
    x = 0;
}
else
{
    x = 0;
    y = 0;
}
output(x);
output(y);
```

Many different arrangements of the various components depicted, as well as components not shown, are possible without departing from the scope of the claims below. Embodiments of the invention have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims. Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A mobile hydraulic equipment vehicle, comprising:
- a joystick, freely and independently movable in an first direction and a second direction;
- a hydraulic device with a first hydraulic function and a second hydraulic function;
- a processor;
- one or more computer-readable media storing computer-executable instructions which, when executed by the processor, perform a method of electronic gating, comprising the steps of:
  - determining a first magnitude corresponding to a position of the joystick in the first direction;
  - determining a second magnitude corresponding to a position of the joystick in the second direction;
  - if the first magnitude is larger than the second magnitude:
    - determining an adjusted first magnitude by reducing the first magnitude based on the second magnitude; and
    - sending the first hydraulic function a first control signal based on the adjusted first magnitude.

2. The vehicle of claim 1, wherein the method further comprises the steps of:
- if the second magnitude is larger than the first magnitude:
  - determining an adjusted second magnitude by reducing the second magnitude based on the first magnitude; and
  - sending the second hydraulic function a second control signal based on the adjusted second magnitude.

3. The vehicle of claim 1, wherein the adjusted first magnitude is determined by reducing the first magnitude proportionally to the second magnitude.

4. The vehicle of claim 1, wherein the adjusted first magnitude is determined in accordance with an equipment profile corresponding to the hydraulic device.

5. The vehicle of claim 4, wherein:
- the vehicle incorporates an additional hydraulic device with a third hydraulic function and a fourth hydraulic function,
- wherein the joystick is configured in a first configuration to operate the first and second hydraulic functions, and
- wherein the joystick is configured in a second configuration to operate the third hydraulic function and the fourth hydraulic function.

6. The vehicle of claim 5, wherein:
- the equipment profile is a first equipment profile;
- the additional hydraulic device is controlled in accordance with a second equipment profile corresponding to the additional hydraulic device, and
- wherein the second equipment profile is different from the first equipment profile.

7. The vehicle of claim 4, wherein the equipment profile is a mutually exclusive equipment profile.

8. A system for controlling an item of hydraulic equipment, comprising:
- a multifunction controller incorporating a plurality of joysticks, each joystick freely and independently movable in an x direction and a y direction;
- a hydraulic controller configured to control a first function of the item of hydraulic equipment and a second function of the item of hydraulic equipment;
- a gating controller configured to:
  - receive a signal from a first joystick of the plurality of joysticks indicating an x magnitude corresponding to a distance the first joystick has been moved in the x direction and a y magnitude corresponding to a distance the joystick has been moved in the y direction;
  - compare the x magnitude to the y magnitude;
  - upon determining that the x magnitude is larger than the y magnitude, adjust the x magnitude based on the y magnitude and adjust the y magnitude to zero; and
  - transmit the adjusted x magnitude and the adjusted y magnitude to the hydraulic controller.

9. The system of claim 8, wherein the gating controller is further configured, to adjust the y magnitude based on the x magnitude and adjust the x magnitude to zero upon determining that the y magnitude is larger than the x magnitude.

10. The system of claim 8, wherein the x magnitude is adjusted in accordance with an equipment profile associated with the item of hydraulic equipment.

11. The system of claim 8, wherein the x magnitude is adjusted by reducing it proportionally to the y magnitude.

12. The system of claim 8, wherein a second joystick of the plurality of joysticks is configured to operate a third function and a fourth function of the item of hydraulic equipment.

13. The system of claim 12, wherein the first joystick is reconfigurable to operate a fifth function and a sixth function of the item of hydraulic equipment.

14. The system of claim 12, wherein the first joystick is configured to operate the first function and the second function in accordance with a first equipment profile, and the second joystick is configured to operate the third function and the fourth function in accordance with a second equipment profile distinct from the first equipment profile.

15. A method of controlling an item of hydraulic equipment having a first function and a second function, comprising the steps of:

receiving, from a joystick freely and independently movable in an x direction and a y direction, an x magnitude indicating how far the joystick has been moved in the x direction and a y magnitude indicating how far the joystick has been moved in the y direction;

comparing the x magnitude and the y magnitude;

if the x magnitude is greater than the y magnitude, adjusting the x magnitude based on the y magnitude; and operating the first function of the item of hydraulic equipment in accordance with the adjusted x magnitude.

16. The method of claim 15, further comprising the step of deactivating the second function of the item of hydraulic equipment if the x magnitude is greater than the y magnitude.

17. The method of claim 15, further comprising the steps of:

if the y magnitude is greater than the x magnitude, adjusting the y magnitude based on the x magnitude, and operating the second function of the item of hydraulic equipment in accordance with the adjusted y magnitude.

18. The method of claim 15, wherein the x magnitude is adjusted based on the y magnitude and an equipment profile corresponding to the item of hydraulic equipment.

19. The method of claim 15, further comprising the steps of receiving, from a user, an indication of a third function and a fourth function of the item of hydraulic equipment;

receiving, from the joystick, an updated x magnitude and an updated y magnitude;

comparing the updated x magnitude and the updated y magnitude;

if the updated x magnitude is greater than the updated y magnitude, adjusting the updated x magnitude based on the updated y magnitude; and operating the third function of the item of hydraulic equipment in accordance with the adjusted updated x magnitude.

20. The method of claim 19, further comprising the steps of:

if the updated y magnitude is greater than the updated x magnitude, adjusting the updated y magnitude based on the updated x magnitude, and operating the fourth function of the item of hydraulic equipment in accordance with the adjusted updated y magnitude.

* * * * *